United States Patent [19]

Brieseck et al.

[11] Patent Number: 4,844,381

[45] Date of Patent: Jul. 4, 1989

[54] AIRBORNE SUBMUNITION MEMBER

[75] Inventors: Bernd Brieseck, Henfenfeld; Josef Nagler, Rothenbach, both of Fed. Rep. of Germany

[73] Assignee: Diehl GmbH & Co., Nurnberg, Fed. Rep. of Germany

[21] Appl. No.: 178,206

[22] Filed: Apr. 6, 1988

[30] Foreign Application Priority Data

Sep. 8, 1987 [DE] Fed. Rep. of Germany ..... 3730019

[51] Int. Cl.[4] ..... F42B 13/32; F42B 13/50

[52] U.S. Cl. ..... 244/3.29; 244/3.28; 102/393

[58] Field of Search ..... 244/3.26, 3.27, 3.28, 244/3.29, 49, 47

[56] References Cited

U.S. PATENT DOCUMENTS

| | | | |
|---|---|---|---|
| 4,558,645 | 12/1985 | Boeder et al. | 102/393 |
| 4,736,908 | 4/1988 | Böder | 244/3.29 |
| 4,752,052 | 6/1988 | Galvin | 244/3.29 |

FOREIGN PATENT DOCUMENTS

| | | | |
|---|---|---|---|
| 251890 | 1/1988 | European Pat. Off. | 244/3.27 |
| 1605347 | 10/1974 | France | 244/3.29 |
| 2121147 | 12/1983 | United Kingdom | 244/3.29 |

*Primary Examiner*—Deborah L. Kyle
*Assistant Examiner*—Michael J. Carone
*Attorney, Agent, or Firm*—Scully, Scott, Murphy & Presser

[57] ABSTRACT

An airborne submunition member, having glide wing retainers which are displaced about the outside on the fuselage or body of the member, in which glide wings are extendable, and which are retracted into the glide wing retainers in the condition of transport. At least one of the glide wing retainers is supported on the body or fuselage of the members as to be rotatable about the longitudinal axis thereof, and wherein this glide wing retainer is turned towards one of the other glide wing retainers in the transport position.

9 Claims, 2 Drawing Sheets

AIRBORNE SUBMUNITION MEMBER

BACKGROUND OF THE INVENTION

1. Field of the Invention

The present invention relates to an airborne submunition member, having glide wing retainers which are displaced about the outside on the fuselage or body of the member, in which glide wings are extendable, and which are retracted into the glide wing retainers in the condition of transport.

2. Discussion of the Prior Art

An airborne submunition member of the type which is under consideration herein as described in the disclosure of German Laid-Open Patent Appln. No. 35 23 769. This airborne member possesses two pairs of glide wings; and in essence, glide wing retainers, which are diametrically displaced about the fuselage or body of the member. The glide wing retainers are attached or constructed on the outside of the fuselage. Hereby, the glide wing retainers and the glide wings do not necessitate any assembly or installation space in the interior of the fuselage of the submunition.

The airborne member is transported in a carrier which is designed to receive a plurality of such airborne members. When the airborne member possesses only two glide wing retainers; and in effect, glide wings, as is the instance in the configuration in German OS No. 35 23 769, then there is no difficulty in finding space for the glide wing retainers in the carrier. However, airborne submunition members possessing a plurality of glide wing retainers which are suitably displaced about the fuselage cannot be readily arranged within the presently available installation volume of the carrier.

SUMMARY OF THE INVENTION

Accordingly, it is an object of the present invention to provide for a submunition member of the above-mentioned type in which a plurality of glide wing retainers which are arranged on the outside of the fuselage of the member necessitate the least possible space within the carrier in the transport position, and in which there are considered the precisely defined space conditions.

The above-mentioned object is achieved in an inventive manner that at least one of the glide wing retainers is supported on the body or fuselage of the members as to be rotatable about the longitudinal axis thereof, and wherein this glide wing retainer is turned towards one of the other glide wing retainers in the transport position.

As a consequence thereof, in the transport position, the glide wing retainers are present at locations which are anyway open or available space within the carrier. Subsequent to the ejection of the airborne member from the carrier, the rotatable glide wing retainer is turned into the desired flying position.

In a preferred embodiment of the invention, a pair of the glide wing retainers is fixedly positioned on the fuselage of the airborne member, and a pair of the glide wing retainers is rotatably supported on the fuselage. As a result thereof, an airborne member which is equipped with four glide wings can be arranged in a compact or space-saving manner within the carrier.

BRIEF DESCRIPTION OF THE DRAWINGS

Further advantageous embodiments of the invention can now be readily ascertained from the following detailed description of an exemplary embodiment thereof, taken in conjunction with the accompanying drawings; in which.

DETAILED DESCRIPTION

Figure 1:
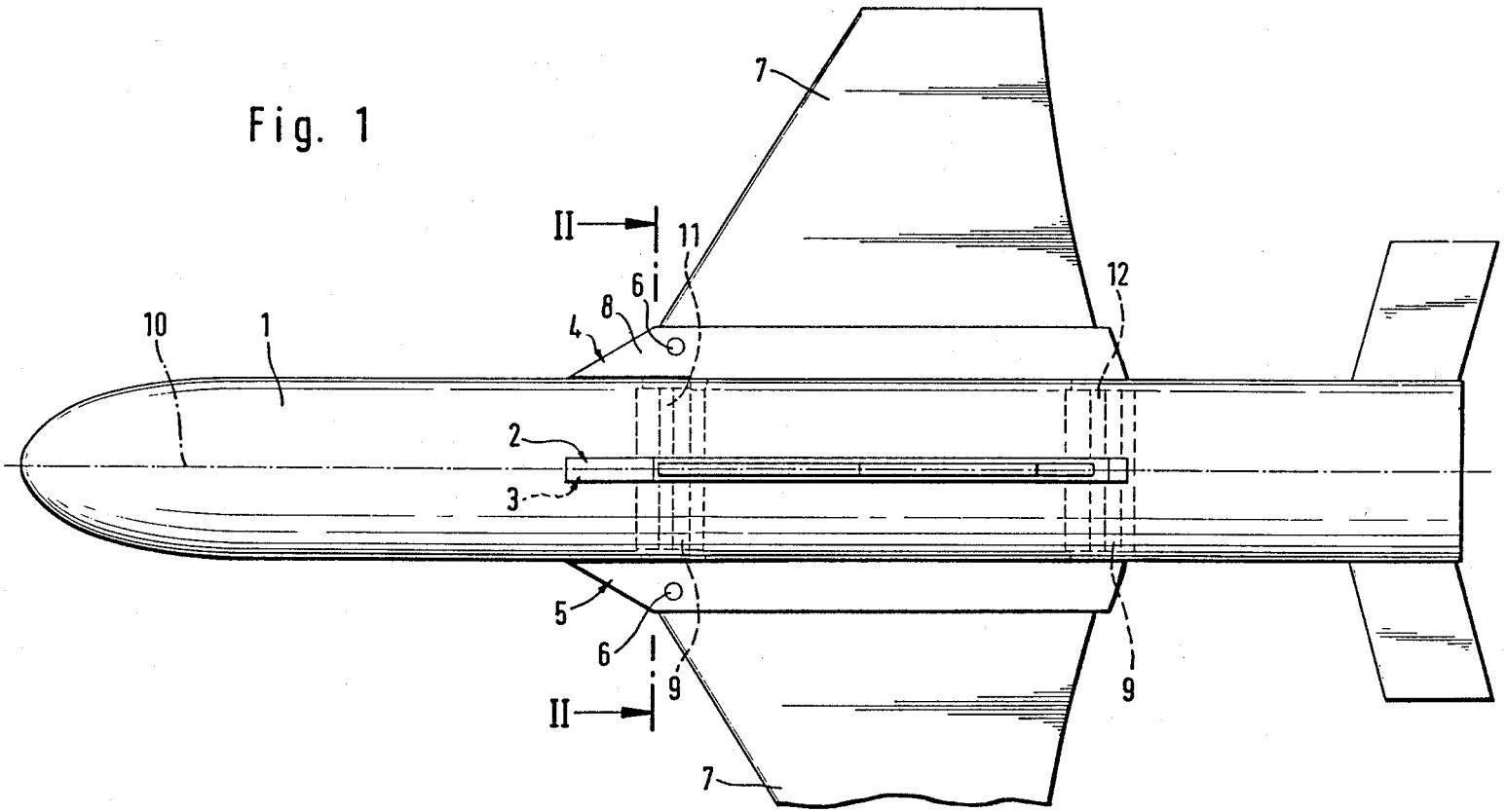
FIG. 1 illustrates a submunition member with the arrangement of the turning device.
Figure 3:
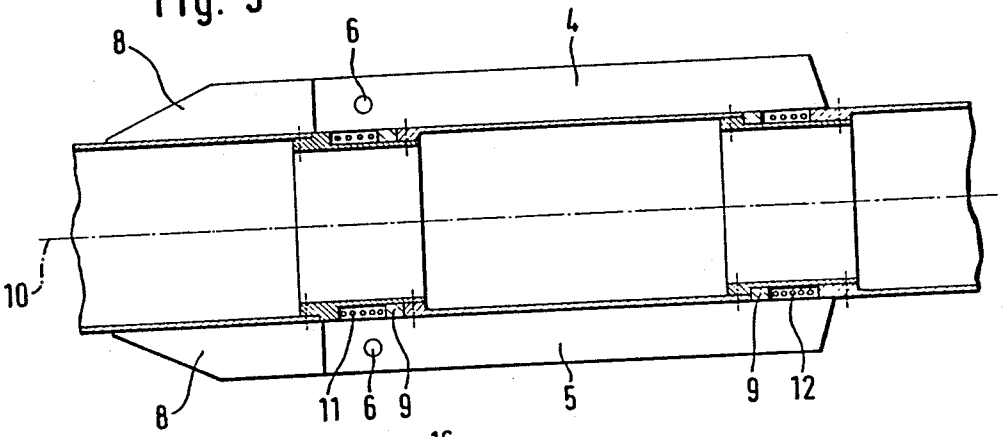
FIG. 3 illustrates a longitudinal sectional view taken along line III—III in FIG. 2 in the region of the turning device.

Arranged about the body or fuselage 1 of an airborne submunition member are four glide wing retainers 2, 3, 4, and 5. Each glide wing retainer 2 through 5 has a bearing or supported location 6 provided thereon for an extendable glide wing 7. In FIG. 1 there is illustrated an extended glide wing 7. The remaining glide wings are not illustrated in the drawings. Each glide wing 7 is constituted of a spar which is supported at the bearing or support location 6, through the intermediary of which there can be unfolded one wing surface, the latter of which is formed by a fabric covering or by plate segments. In the forward portion 8 of each of the glide wing retainer 2 through 5 there is arranged a mechanism for effectuating the extension of the glide wings 7.

The glide wing retainers 2, 3 are fixed in position on the body 1 of the airborne member. The glide wing retainers 4, 5 are provided on a ring member 9 which is supported on the fuselage 1 so as to be rotatable about the longitudinal axis 10 thereof. Torsion springs 11, 12 are arranged intermediate the fuselage 1 and the ring member 9.

Figure 4:
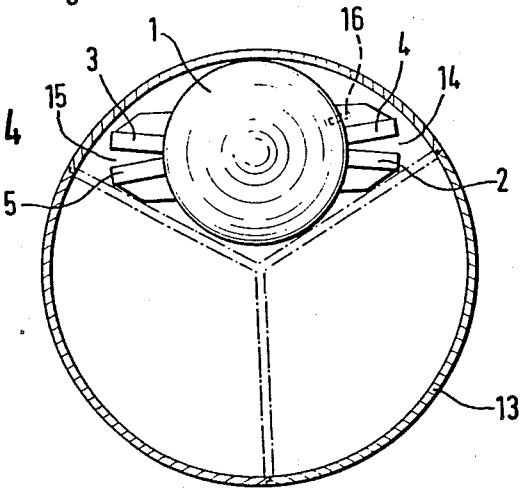
FIG. 4 illustrates the the integrated conditions of the member within a carrier.

Illustrated in FIG. 4 of the drawings is a carrier 13 which, in transverse section, is able to receive three airborne members, showing an airborne member therein in the transport condition. Hereby, the ring member 9 is rotated in such a manner opposite to the force of the torsion springs 11, 12, that the glide wing retainer 5 is positioned close to the glide wing retainer 2, and the glide wing retainer 5 is positioned close to the glide wing retainer 3. Consequently, the rotatable pair 4, 5 of the glide wing retainers is turned towards the fixedly positioned pair 2, 3 of the glide wing retainers. The glide wing retainers 2 through 5, in the transport positions thereof, are located within the space 14, 15 which is already available within the carrier 13. In the radial direction of the carrier 13, the glide wing retainers 4, 5 do not necessitate the need for any additional space.

In the transport position, the ring member 5 is restrained by means of a securing device 16.

Figure 2:
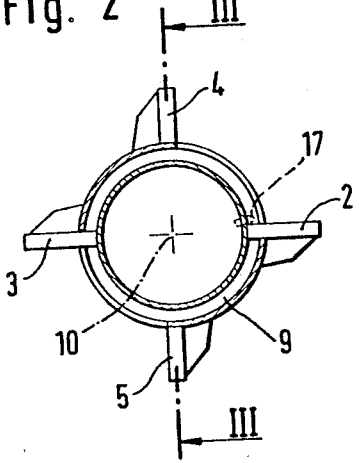
FIG. 2 illustrates a transverse sectional view taken along line II—II in FIG. 1.

After the ejection of the airborne member from the carrier 13, there is triggered the securing device 16. As a result thereof, the ring member 9 is rendered so as to be rotatable relative to the body 1 of the airborne member. In response to the action of the torsion springs 11, 12, the ring member 9, in conjunction with the glide wing retainers 4, 5, is rotated into the position which is illustrated in FIG. 2. This rotation may be effectuated through either a pneumatic power element (not shown), or through the application of aerodynamic forces. In this flying condition, the wing member 9, together with the glide wing retainers 4, 5, is held in position by means of a locking device 17. Subsequently, there are actuated the mechanisms in the forward portion 8 of each of the glide wing retainers 2 through 5, and the glide wing 7 are extended and locked into their final extended position.

What is claimed is:

1. An airborne submunition member having a fuselage; glide wing retainers arranged spaced about on said fuselage; extendable glide wings located in each of said glide wing retainers, said glide wings being retracted into the glide wing retainers in the transport condition thereof; at least one of the glide wing retainers on said fuselage being supported for rotation about the longitudinal axis of the fuselage, said glide wing retainer being turned towards one of the other glide wing retainers in the transport condition.

2. An airborne submunition member as claimed in claim 1, wherein said rotatable glide wing retainer comprises a pair of said glide wing retainers being fixedly attached to said fuselage and a further pair of said glide wing retainers being rotatably supported on said fuselage.

3. An airborne submunition member as claimed in claim 1, wherein said rotatable glide wing retainer is arranged on a ring member encompassing said fuselage.

4. An airborne submunition member as claimed in claim 2, comprising a torsion spring for turning said rotatable glide wing retainers from the transport condition into a flying position.

5. An airborne submunition member as claimed in claim 1, comprising a pneumatic power element for effectuating the rotation of said at least one rotatable glide wing retainer.

6. An airborne submunition member as claimed in claim 1, wherein securing means restrains said at least one rotatable glide wing retainer condition, said securing means releasing after ejection of said airborne member from a carrier.

7. An airborne submunition member as claimed in claim 1, wherein locking means arrest said at least one rotatable glide wing retainer in a flying position.

8. An airborne submunition member as claimed in claim 1, each of said glide wing retainers being rotatable.

9. An airborne submunition member as claimed in claim 1, wherein the rotation of said at least one rotatable glide wing retainer is effectuated in response to aerodynamic forces being exerted thereon.

* * * * *